US010100677B2

(12) United States Patent
Miller et al.

(10) Patent No.: US 10,100,677 B2
(45) Date of Patent: Oct. 16, 2018

(54) FIXTURE FOR RESTRAINING A TURBINE WHEEL

(71) Applicant: General Electric Company, Schenectady, NY (US)

(72) Inventors: Maxwell Evan Miller, Simpsonville, SC (US); Jason Matthew Clark, Maryville, TN (US); Sandra Beverly Kolvick, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 30 days.

(21) Appl. No.: 15/277,354

(22) Filed: Sep. 27, 2016

(65) Prior Publication Data

US 2018/0087407 A1 Mar. 29, 2018

(51) Int. Cl.

| | |
|---|---|
| ***F01D 25/28*** | (2006.01) |
| ***F01D 5/02*** | (2006.01) |
| ***F01D 25/24*** | (2006.01) |
| ***F01D 5/00*** | (2006.01) |

(52) U.S. Cl.

CPC ..... *F01D 25/285* (2013.01); *F01D 5/005* (2013.01); *F01D 5/02* (2013.01); *F01D 25/243* (2013.01); *F05D 2230/72* (2013.01); *F05D 2260/02* (2013.01)

(58) Field of Classification Search

CPC ..... Y10T 403/7094; Y10T 403/70; F01D 25/243; F01D 25/285; F01D 5/02; F01D 2220/32; F05D 2260/30; F05D 2230/60; F05D 2230/72; F05D 2230/68; F05D 2230/80; B27F 1/08; E04B 2/08; E04B 2/18; E04B 2/32; E04B 2/46; E04B 2001/2624; E04B 2001/2628; E04B 2001/2632; E04B 2002/0252; F04D 29/644; F05B 2260/30; F05B 2230/60; F05B 2230/61; F05B 2230/80; A47B 2230/0077

USPC ..... 403/381, 345

See application file for complete search history.

(56) References Cited

U.S. PATENT DOCUMENTS

| | | | | |
|---|---|---|---|---|
| 3,721,506 A * | 3/1973 | Anderson | F01D 5/3038 | 416/215 |
| 4,630,982 A * | 12/1986 | Fenner | B61D 45/001 | 24/265 CD |
| 5,284,406 A | 2/1994 | Mueller et al. | | |
| 6,016,600 A * | 1/2000 | Kennell | B23P 6/002 | 29/889.1 |
| 6,638,006 B2 * | 10/2003 | Selby | F01D 5/3038 | 415/9 |
| 8,142,161 B2 * | 3/2012 | Prince | F01D 5/323 | 416/221 |

(Continued)

FOREIGN PATENT DOCUMENTS

WO WO-2015110749 A1 * 7/2015 ..... F01D 25/162

*Primary Examiner* — Josh Skroupa
*Assistant Examiner* — Cory B Siegert
(74) *Attorney, Agent, or Firm* — James W. Pemrick; Ernest G. Cusick; Frank A. Langraff

(57) ABSTRACT

A fixture for restraining a wheel of a turbomachine is provided. The fixture includes a dovetail section adapted for insertion into a dovetail slot of the wheel, and a mounting section located adjacent to, or formed integrally with, the dovetail section. At least one coupling ring is attached to a top of the mounting section. The at least one coupling ring is adapted to be secured to a stationary anchoring point via a restraint.

12 Claims, 10 Drawing Sheets

(56) References Cited

U.S. PATENT DOCUMENTS

| | | | | |
|---|---|---|---|---|
| 8,267,664 | B2 * | 9/2012 | Tipton | F01D 5/326<br>416/220 A |
| 8,414,268 | B2 * | 4/2013 | Aiello | F01D 5/32<br>416/215 |
| 9,120,648 | B2 * | 9/2015 | Okawa | B66C 1/66 |
| 9,429,041 | B2 * | 8/2016 | Holmes | B25B 27/14 |
| 9,745,995 | B2 * | 8/2017 | Jevons | F04D 29/34 |
| 2006/0055188 | A1 * | 3/2006 | Koch | B66C 1/108<br>294/215 |
| 2016/0201556 | A1 * | 7/2016 | Kolvick | F01D 5/3007<br>29/888.012 |
| 2017/0030222 | A1 * | 2/2017 | De Sousa | F01D 25/162 |
| 2017/0218973 | A1 * | 8/2017 | Bishop | F04D 29/30 |

* cited by examiner

FIXTURE FOR RESTRAINING A TURBINE WHEEL

BACKGROUND OF THE INVENTION

The apparatus described herein relates generally to turbomachinery and, more specifically, to a fixture for restraining a turbine wheel during a blade removal or installation procedure.

Turbomachines need regular maintenance to keep up with the cycle type, in which some cases are continuous (6,000 hours/year or more). During an inspection maintenance outage, the blades in the turbine section of the turbomachine may need to be replaced. The top half of the turbine case is removed, and technicians will restrain the rotor from rolling and begin to remove or replace the turbine blades. To restrain the rotor, technicians have tied a strap around a blade and then attached it to somewhere in the turbine compartment. This known method could result in near miss or incidents which involve the rotor rolling due to a broken strap, as well as damage caused to the blade. The known method that uses a strap presents a risk of injury, safety concerns, as well as requiring possible replacement parts due to hardware damage.

BRIEF DESCRIPTION OF THE INVENTION

In an aspect of the present invention, a fixture for restraining a wheel of a turbomachine is provided. The fixture includes a dovetail section adapted for insertion into a dovetail slot of the wheel, and a mounting section located adjacent to, or formed integrally with, the dovetail section. At least one coupling ring is attached to a top of the mounting section. The at least one coupling ring is adapted to be secured to a stationary anchoring point via a restraint.

In another aspect of the present invention, a fixture for restraining a wheel of a turbomachine is provided. The fixture has a dovetail section adapted for insertion into a dovetail slot of the wheel. The dovetail section having a dovetail shaped profile or fir tree shaped profile adapted to interlock with corresponding notches or recesses in the dovetail slot of the wheel. The dovetail section has an aft end and a forward end, and both the aft end and the forward end have a threaded hole adapted for securing a fastener. A mounting section is located adjacent to, or formed integrally with, the dovetail section. The mounting section has at least one threaded hole adapted for attaching a coupling ring to the mounting section. A coupling fastener secures the coupling ring to the mounting section via the at least one threaded hole. The coupling ring is attached to a top portion of the mounting section, and the coupling ring is adapted to be secured to a stationary anchoring point via a restraint.

In yet another aspect of the present invention, a method for restraining a wheel of a turbomachine is provided. The method includes a step of inserting a fixture into a dovetail slot in the wheel. The fixture includes a dovetail section adapted for insertion into the dovetail slot, and a mounting section located adjacent to, or formed integrally with, the dovetail section. The mounting section is adapted to connect to a coupling ring, and the coupling ring is attached to a top portion of the mounting section. An attaching step attaches at least one counterbore assembly to a stationary structure. A connecting step connects a restraint to the at least one coupling ring and the at least one counterbore assembly.

DETAILED DESCRIPTION OF THE INVENTION

One or more specific aspects/embodiments of the present invention will be described below. In an effort to provide a concise description of these aspects/embodiments, all features of an actual implementation may not be described in the specification. It should be appreciated that in the development of any such actual implementation, as in any engineering or design project, numerous implementation-specific decisions must be made to achieve the developers' specific goals, such as compliance with machine-related, system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," and "the" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "one aspect" or "an embodiment" or "an aspect" of the present invention are not intended to be interpreted as excluding the existence of additional embodiments or aspects that also incorporate the recited features.

Figure 1:
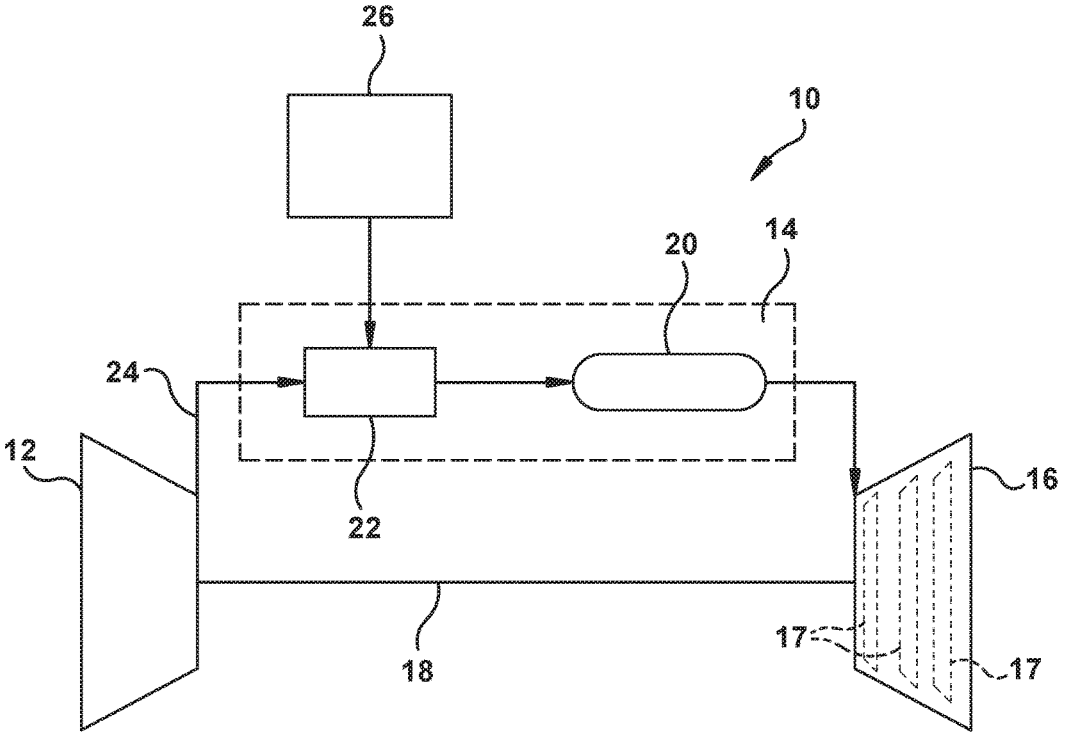
FIG. 1 is a schematic illustration of a gas turbine system.

Referring to FIG. 1, a turbomachine, such as a gas turbine, is schematically illustrated with reference numeral 10. The gas turbine 10 includes a compressor 12, a combustor assembly 14, a turbine 16, and a shaft 18. It is to be appreciated that one embodiment of the gas turbine 10 may include a plurality of compressors 12, combustor assemblies 14, turbines 16 and/or shafts 18. The compressor 12 and the turbine 16 are coupled by the shaft 18. The shaft 18 may be a single shaft or a plurality of shaft segments coupled together to form the shaft 18.

The combustor assembly 14 uses a combustible liquid and/or gas fuel, such as a natural gas or a hydrogen rich synthetic gas, to run the gas turbine 10. The combustor assembly 14 includes a combustor chamber 20 that is in fluid communication with a fuel pre-mixer 22 that is in fluid communication with an airflow 24 and a fuel source 26. The fuel pre-mixer 22 creates an air-fuel mixture, and discharges the air-fuel mixture into the combustor chamber 20, thereby causing a combustion that creates a hot pressurized exhaust gas. The combustor chamber 20 directs the hot pressurized gas through a transition piece into the turbine 16, causing rotation of the turbine 16. Rotation of the turbine 16 causes the shaft 18 to rotate, thereby compressing air as it flows into the compressor 12. The turbine section 16 has multiple rotatable wheels 17 on which a plurality of blades are mounted. In this example, three stages of turbine wheels 17 are shown, and each wheel would be paired with a stator vane stage (not shown). In general, turbomachines include, compressors, gas turbines and steam turbines.

Figure 2:
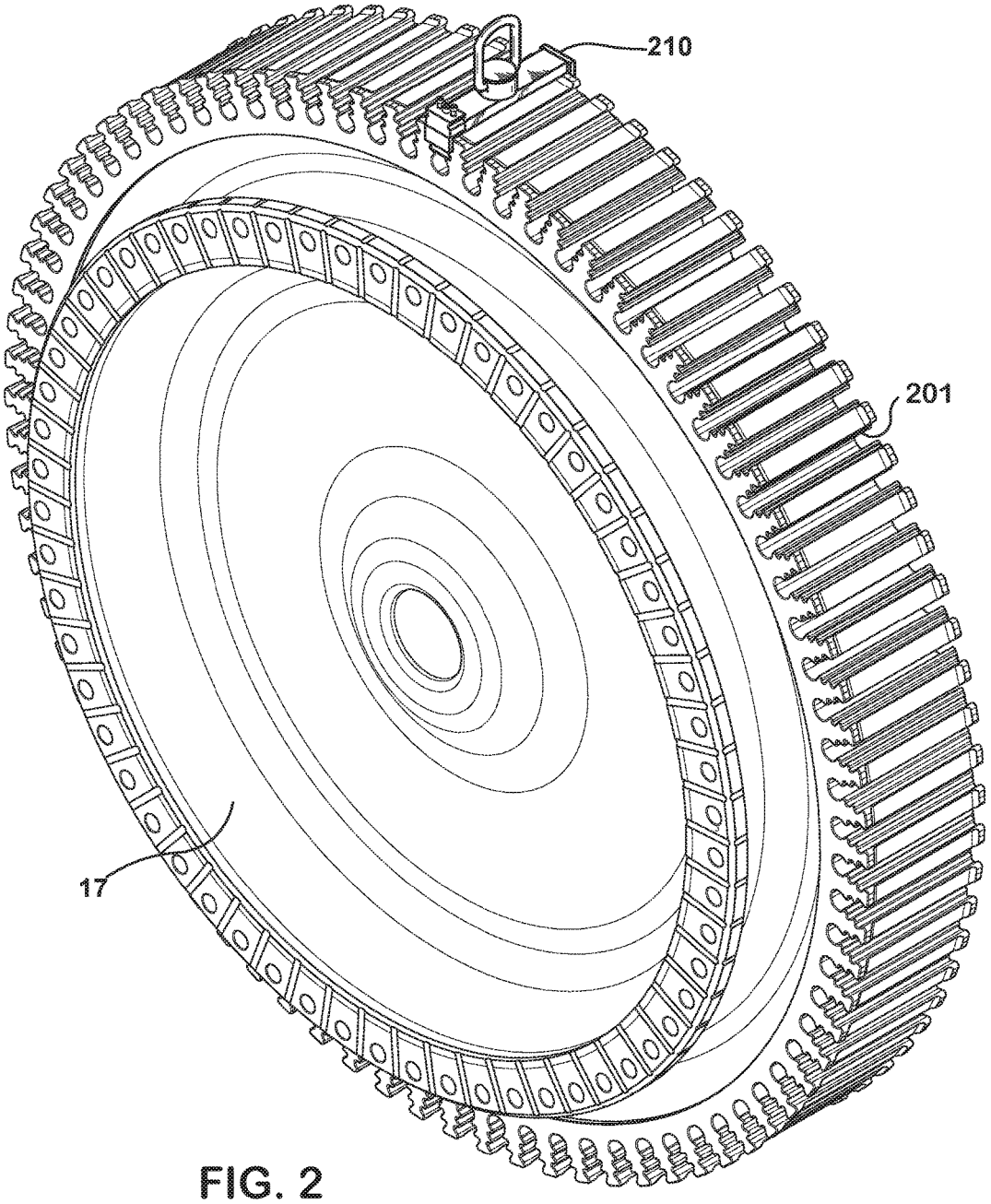
FIG. 2 illustrates a perspective view of single turbine wheel.

FIG. 2 illustrates a perspective view of single turbine wheel 17. The wheel 17 includes a series of circumferentially arranged dovetail slots 201. A turbine blade (not shown) is inserted into each of these dovetail slots 201. During service (or assembly) of the turbomachine 10, the blades may need to be removed or installed. In a service example, the blades are removed and the used blades are either repaired and re-installed or just replaced with new blades. Turbomachines, such as gas or steam turbines, have large and heavy components. The wheel 17 with blades attached is one example of a heavy component, and this wheel is balanced to reduce vibrations. However, as the blades are removed from wheel 17, the wheel's center of gravity changes, and the wheel will want to rotate in either a clockwise or counter-clockwise direction. This can present a serious safety hazard to people working on the turbine, as an unexpected wheel rotation can force a blade (or other wheel component) onto personnel. Therefore, it would be desirable to restrain the rotor from rotation during a blade removal or installation procedure. A fixture 210 for restraining the wheel 17 is the focus of this disclosure, and will be described in greater detail herein below.

Figure 3:
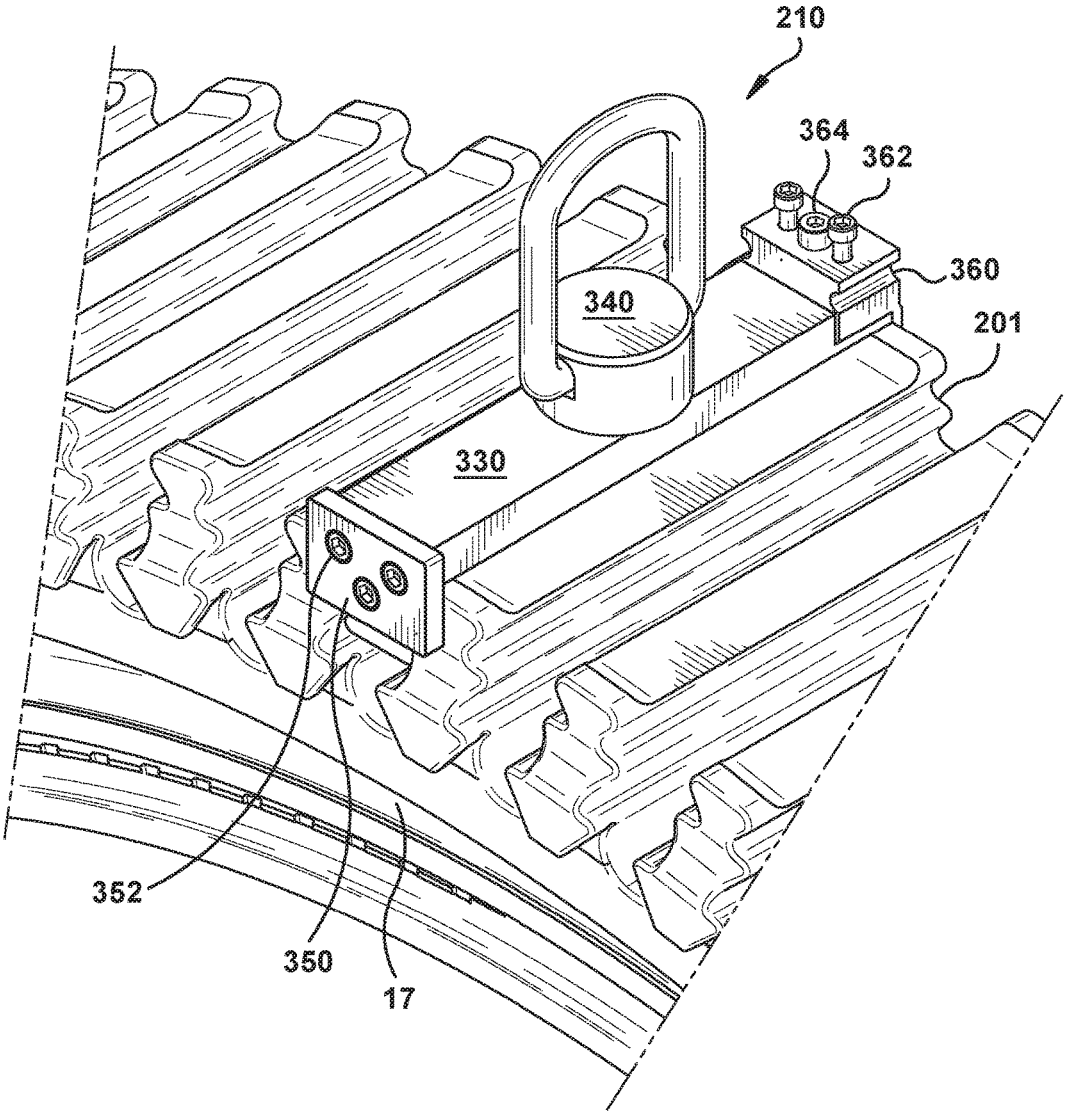
FIG. 3 illustrates a perspective view of a fixture for restraining a wheel of a turbomachine, according to an aspect of the present invention.
Figure 4:
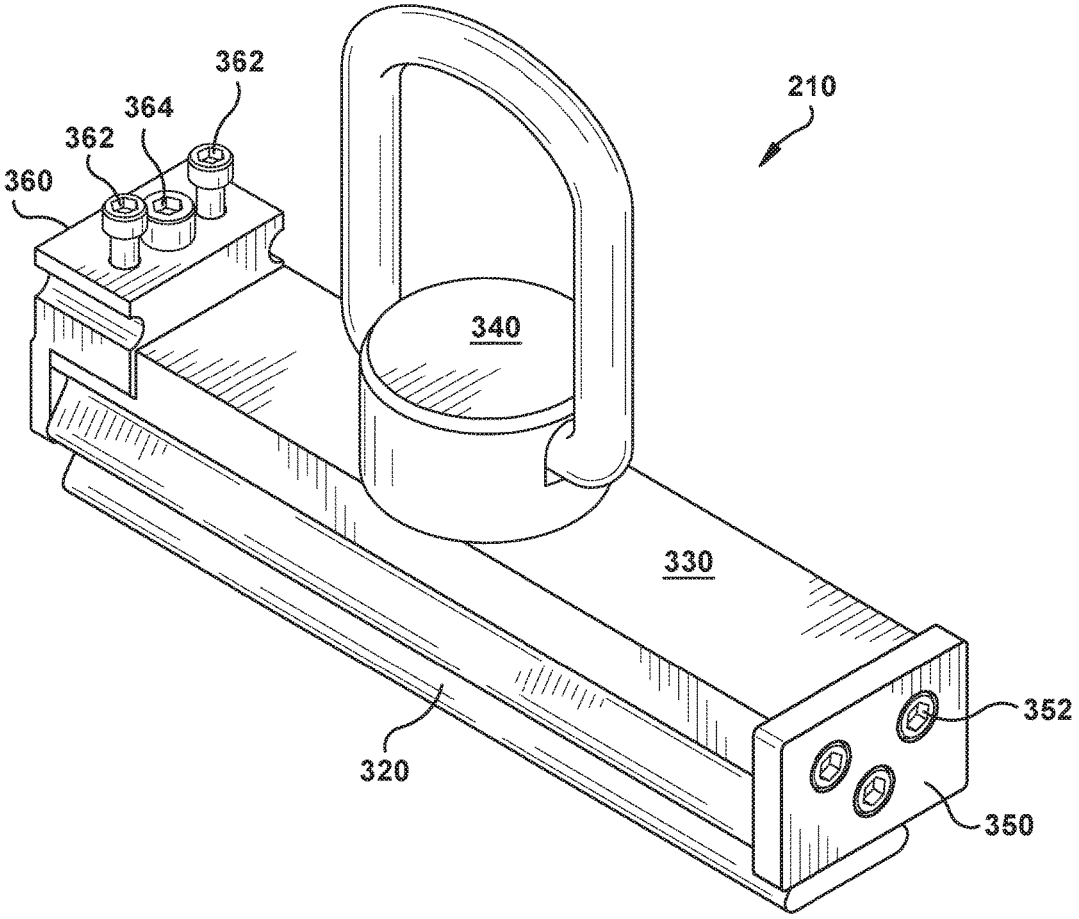
FIG. 4 illustrates a perspective view of the fixture 210, according to an aspect of the present invention.

FIG. 3 illustrates a perspective view of the fixture 210 for restraining a wheel 17 of a turbomachine 10. FIG. 4 illustrates a perspective view of the fixture 210. The fixture 210 includes a dovetail section 320 adapted for insertion into the dovetail slot 201 of the wheel 17. The dovetail section 320 has a dovetail shaped profile or fir tree shaped profile, which include a plurality of ridges and valleys, adapted to interlock with corresponding notches or recesses in the dovetail slot 201 of wheel 17. Typically, the peak height of each ridge decreases in height as the peaks become nearer to the bottom (radially inner portion) of the dovetail section. A mounting section 330 is located on top of and adjacent to, or formed integrally with, the dovetail section 320. In one example, the dovetail section 320 and mounting section 330 are cast as, or machined from, a single piece of material, and this material may be 4140-HT (heat treated) high alloy tool steel as it has good strength, toughness, and mechanical properties. Alternatively, any other suitable material may be used as desired in the specific application. Fixture 210 also includes at least one coupling ring 340 attached to the mounting section 330. The coupling ring 340 may be a hoist ring, shackle or other suitable coupling device. The coupling ring 340 may be attached to the top of the mounting section (as shown). In this example, a threaded fastener (not shown) that is attached to the coupling ring 340 is screwed into an internally threaded hole (not shown) in the top of the mounting section 330. A washer may be interposed between the bottom of the coupling ring and the top of the mounting section, if desired. The coupling ring 340 may also be attached so that it swivels about a radial axis (with respect to the turbomachine).

A back plate 350 is attached to a first axial end of the mounting section, and is adapted to extend over an axial face of the dovetail slot to restrain axial movement of the fixture. The back plate 350 may be a substantially rectangular and planar member, as shown. A plurality of fasteners 352 (three are shown) may be used to attach the back plate 350 to the mounting section 330. The first axial end of the mounting section includes a plurality of internally threaded holes configured for use with fasteners 352. The fasteners 352 may be screws, bolts or any other suitable fastening device.

A sliding block 360 may be attached to the top of the mounting section 330 near an opposing (or second) axial end of the mounting section. The sliding block 360 is adapted to extend over an axial face of the dovetail slot 201 and restrain axial movement of the fixture 210. In addition, the sliding block 360 is adapted to slide up and down along a radial axis, with respect to the turbomachine, so that the fixture 210 can be inserted into the dovetail slot 210 when the sliding block is at an upper position. The fixture 210 is restrained from axial movement when the sliding block 360 is in a lower position, as shown. Two pins 362 are attached to the mounting section and act as guides for the radial (or up and down) movement of the sliding block. The pins 362 can be screwed into the mounting section via corresponding threaded holes. A lock screw 364, such as a shoulder screw, is used to lock the sliding block in place and prevent radial movement thereof. The lock screw 364 also locks the sliding block in place to prevent axial movement of the fixture. In use, the coupling ring 340 is secured to a stationary anchoring point via a restraint. When both the back plate 350 and sliding block 360 are installed and locked in place, the dovetail section 320 is locked in the dovetail slot 201, and the fixture will not slide out of the slot 201.

Figure 5:
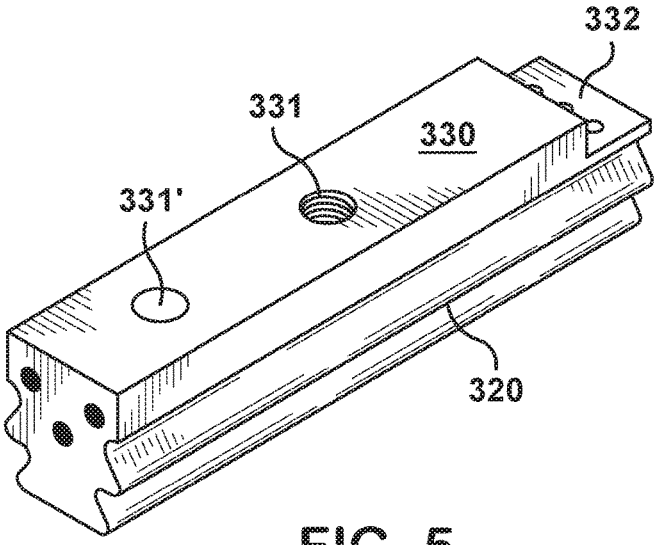
FIG. 5 illustrates a perspective view of the dovetail section and mounting section, according to an aspect of the present invention.

FIG. 5 illustrates a perspective view of the dovetail section 320 and mounting section 330. The mounting section includes a stepped region 332 configured for use with the sliding block 360. The stepped region includes a plurality of holes for use with the fastener 364 and pins 362. The holes for the pins may or may not be internally threaded, as the pins can be press fit into the holes if desired. The hole for the fastener 364 is preferred to be internally threaded. In addition, one or more internally threaded holes 331, 331' may be provided on the top of the mounting section for use with coupling rings.

Figure 8:
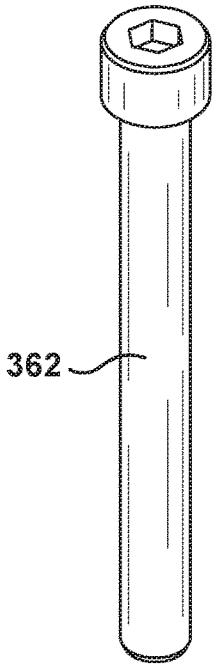
FIG. 8 illustrates a perspective view of the pin used with the sliding block, according to an aspect of the present invention.
Figure 6:
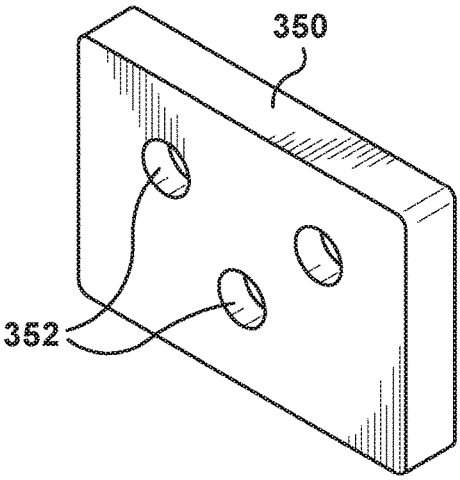
FIG. 6 illustrates a perspective view of the back plate, according to an aspect of the present invention.
Figure 7:
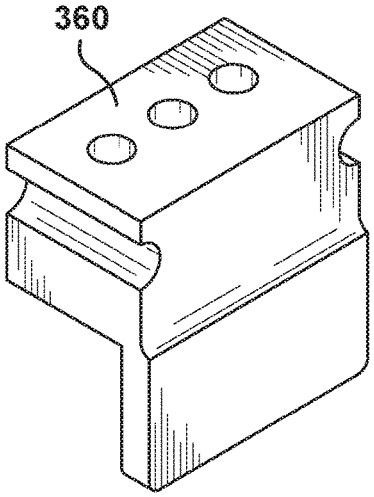
FIG. 7 illustrates a perspective view of the sliding block, according to an aspect of the present invention.

FIG. 6 illustrates a perspective view of the back plate 350. The back plate may be a generally planar and rectangular element having a plurality of holes 352 for securing to the mounting section 330 and/or the dovetail section 320. FIG. 7 illustrates a perspective view of the sliding block 360. The sliding block 360 fits into stepped region 332 and can slide up and down along pins 362. The center hole in the sliding block is used for a locking fastener that prevents the up and down movement of the sliding block. FIG. 8 illustrates a perspective view of the pin 362 used with the sliding block 360. The pin may include an externally threaded bottom section, or alternatively may be smooth and press fit into the holes in the sliding block.

Figure 9:
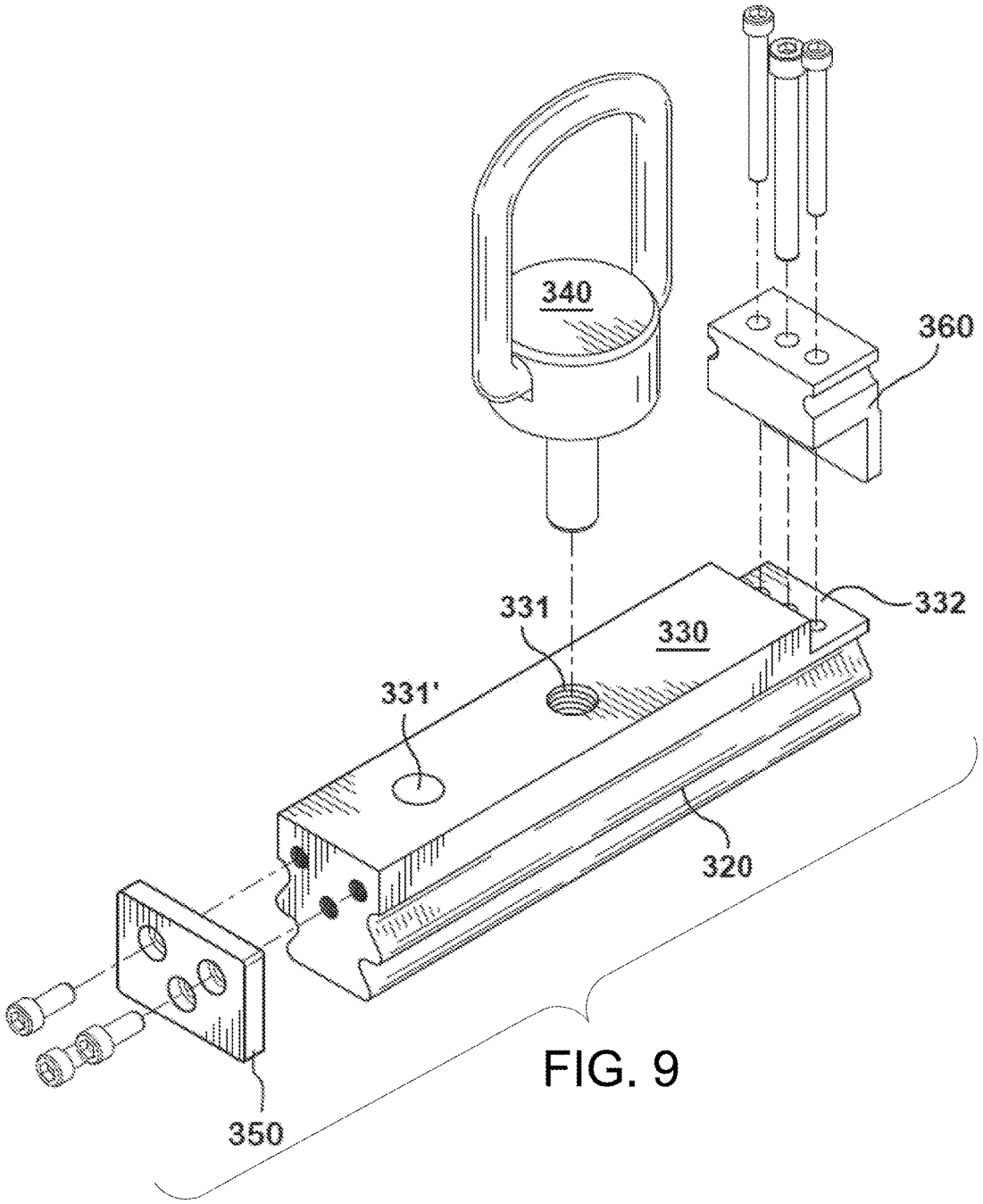
FIG. 9 illustrates an exploded, perspective view of the fixture, according to an aspect of the present invention.

FIG. 9 illustrates an exploded, perspective view of the fixture 210. To prevent the fixture from sliding out of the dovetail slot 201, the back plate 350 and sliding block 360 are installed. The back plate 350 is attached/secured to a first side of the fixture. The sliding block 360 is installed on a second and opposing side of the fixture. When both the back plate 350 and sliding block 360 are installed the fixture is locked to the wheel. The coupling ring 340 is attached to the top of mounting section 330. It is to be understood that one or more coupling rings may be used, for example, one or more coupling rings may be located on the top (or radially outer surface) of the mounting section 330. As shown in FIG. 5 dovetail section 320 has a straight profile adapted for use with a straight dovetail slot 201.

Figure 10:
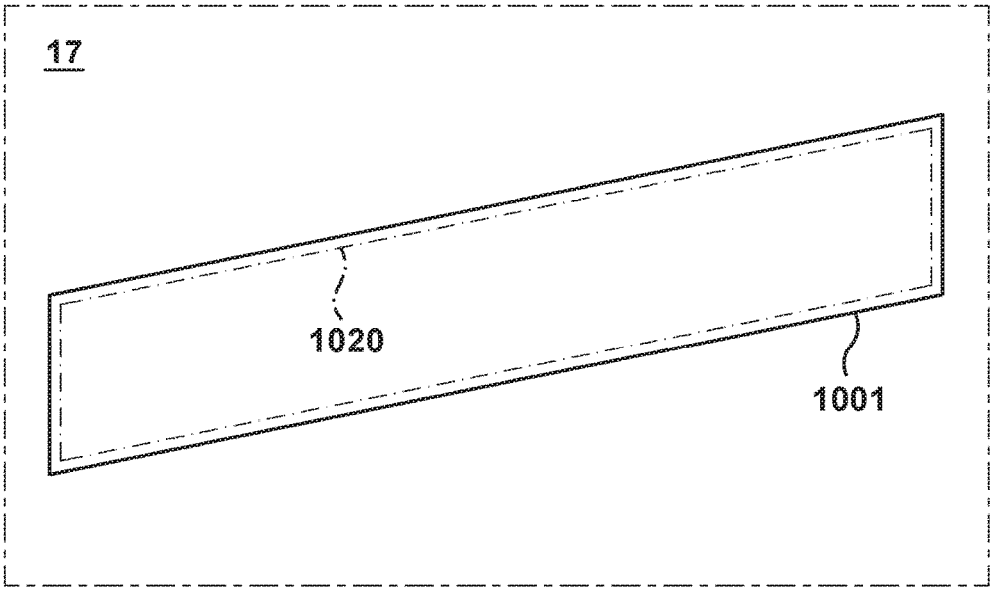
FIG. 10 illustrates a top, cross-sectional view of the fixture located in a dovetail slot.
Figure 11:
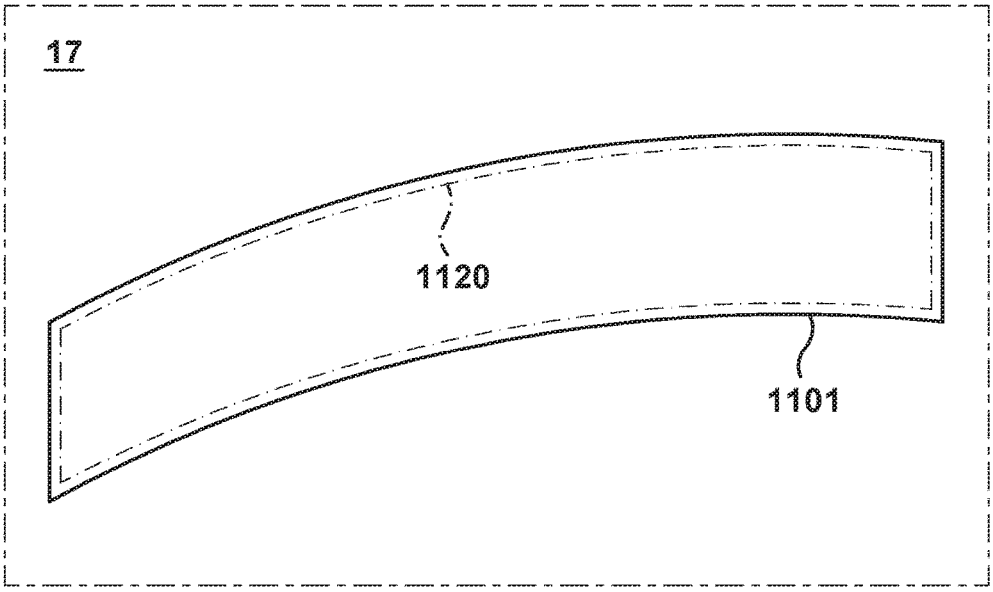
FIG. 11 illustrates a top, cross-sectional view of the fixture located in a curved, axial-entry type of dovetail slot.

FIG. 10 illustrates a top, cross-sectional view of the fixture located in a dovetail slot. The dovetail section 1020 has an angled profile adapted for use with an angled dovetail slot 1001. The axial extending sides of slot 1001 are not orthogonal to the axial faces thereof. FIG. 11 illustrates a top, cross-sectional view of the fixture located in a dovetail slot. The dovetail section 1120 has a curved profile adapted for use with a curved dovetail slot 1101. This curved, axial-entry type of configuration may be used in steam turbines, or any other turbomachine as desired.

Figure 12:
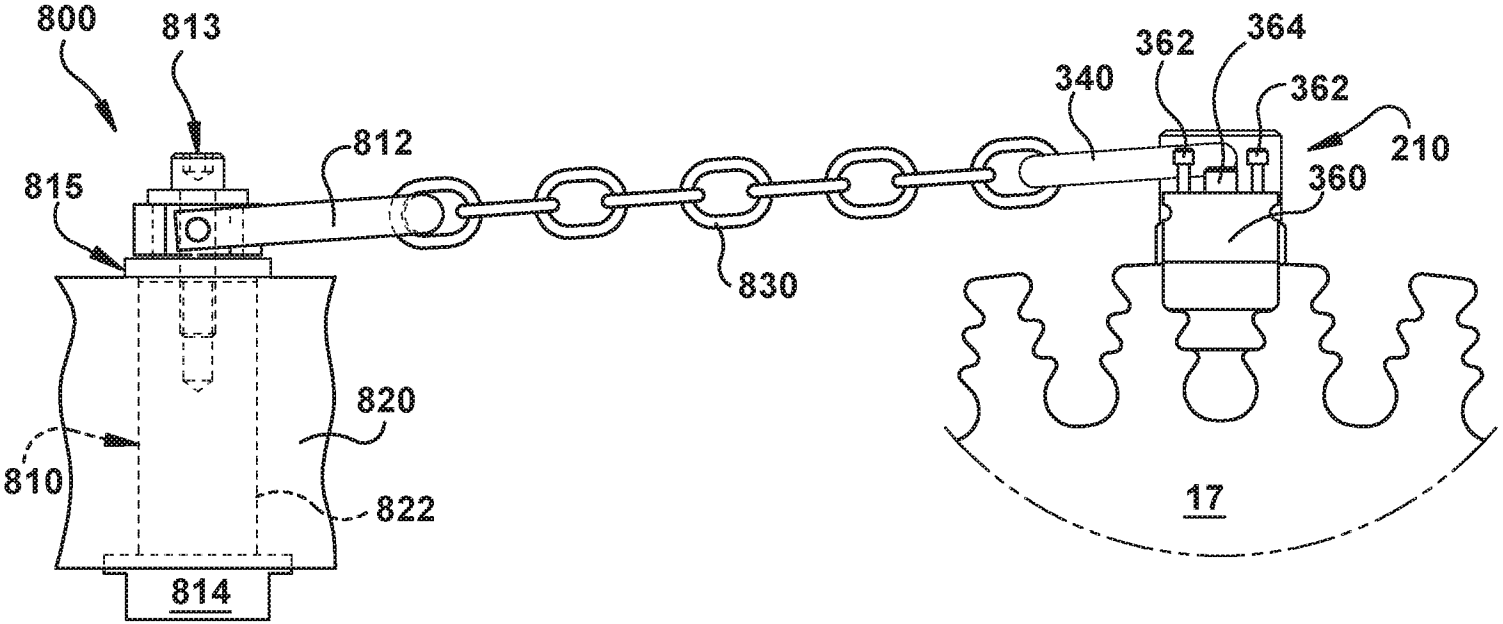
FIG. 12 illustrates a partial side view of the fixture installed in a wheel and connected to a stationary anchoring point on the turbomachine's casing.

FIG. 12 illustrates a partial side view of the fixture installed in a wheel and connected to a stationary anchoring point on the turbomachine's casing. The stationary anchoring point 800 may include at least one counterbore assembly 810 having a coupling ring 812 attached thereto. The counterbore assembly 800 is adapted to be secured to a stationary structure 820, such as a turbomachine casing, shell or flange. In the example shown, the stationary structure 820 is the bottom half of a turbine case. The counterbore assembly 810 has a counterbore insert 814 that has a portion adapted to extend into a hole 822 of the turbine case 820. A head of the counterbore insert 814 is larger than the hole 822 diameter. The shaft portion of the counterbore insert (the portion that goes into the turbine casing hole 822) includes an internally threaded hole that is configured for use with fastener 813. Alternatively, the counterbore insert may be a cylindrical element having two opposing internally threaded holes, one for use with fastener 813 and another for a bolt (e.g., which would take the place of 814). The fastener 813 connects the coupling ring 812 to the counterbore insert 814, and therefore to the turbine case 820. If desired a washer 815 may be interposed between the turbine case 820 and coupling ring 812. The coupling ring 340 is secured to the coupling ring 812 on stationary anchoring point 800 by restraint 830, which may be a chain, chain with come-along, cable or wire. Come-alongs may also be referred to as ratchet pullers, ratchet mechanisms or cable (or chain) pullers. Lever chain hoists or similarly functioning devices may be used as well for restraint 830.

Figure 13:
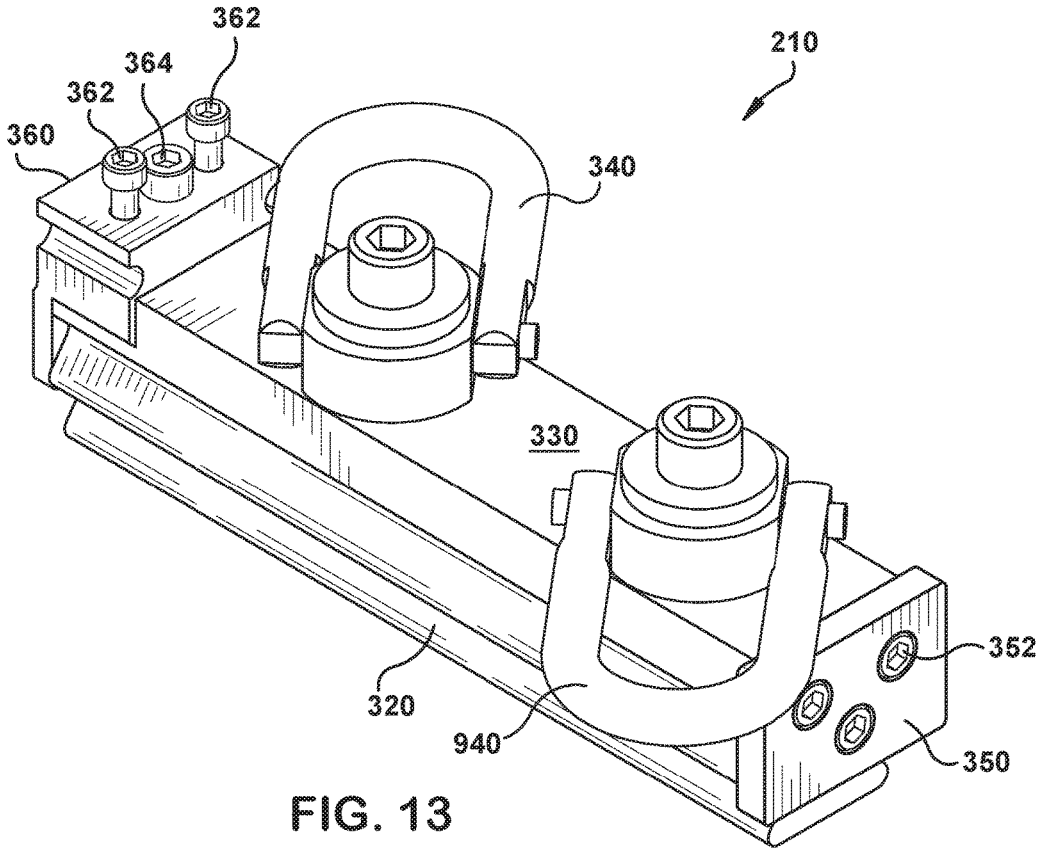
FIG. 13 illustrates a perspective view of the fixture.

FIG. 13 illustrates a perspective view of the fixture. The fixture 201 includes two coupling rings 340 and 940. Coupling rings 340 and 940 are both attached to a top portion of the mounting section 330. This type of configuration allows two restraints 830 to be attached to the fixture. The restraints may extend in the same direction, or extend in generally opposing directions.

Figure 14:
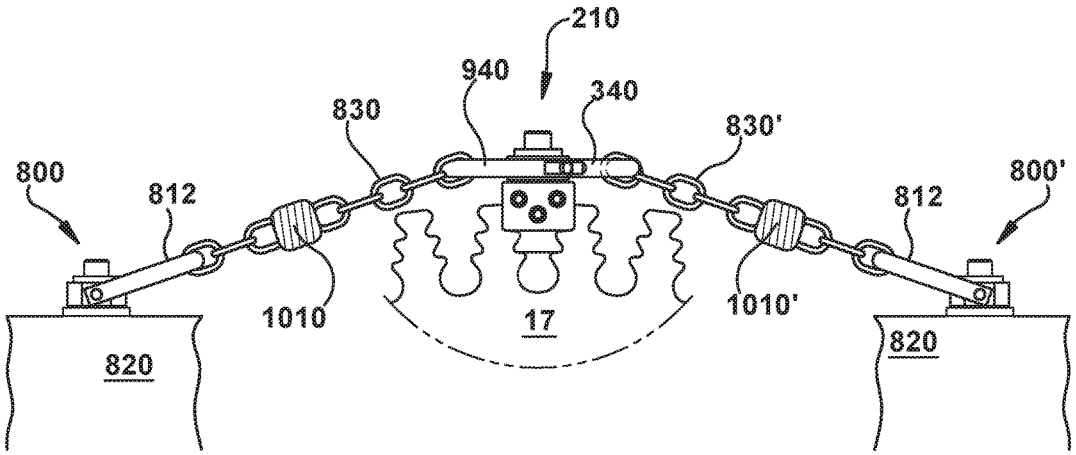
FIG. 14 illustrates a partial side view of the fixture of FIG. 13 installed in a dovetail slot of wheel, and the fixture is connected to two stationary anchoring points on the turbomachine's casing.

FIG. 14 illustrates a partial side view of the fixture 210 of FIG. 13 installed in a dovetail slot of wheel 17, and the fixture is connected to two stationary anchoring points on the turbomachine's casing. The first stationary anchoring point 800 is connected to the fixture 210 via restraint 830 (shown by a dotted line). The second stationary anchoring point 800' is connected to the fixture 210 via restraint 830' (shown by a dotted line). The two stationary anchoring points 800, 800' may be on opposing sides of the turbine case. The restraints 830, 830' may be tightened by the use of a come-along 1010 or 1010'. However, the restraints 830 do not need to be excessively tightened, as simply taking up the slack will be sufficient to prevent or restrain undesired wheel rotation.

Figure 15:
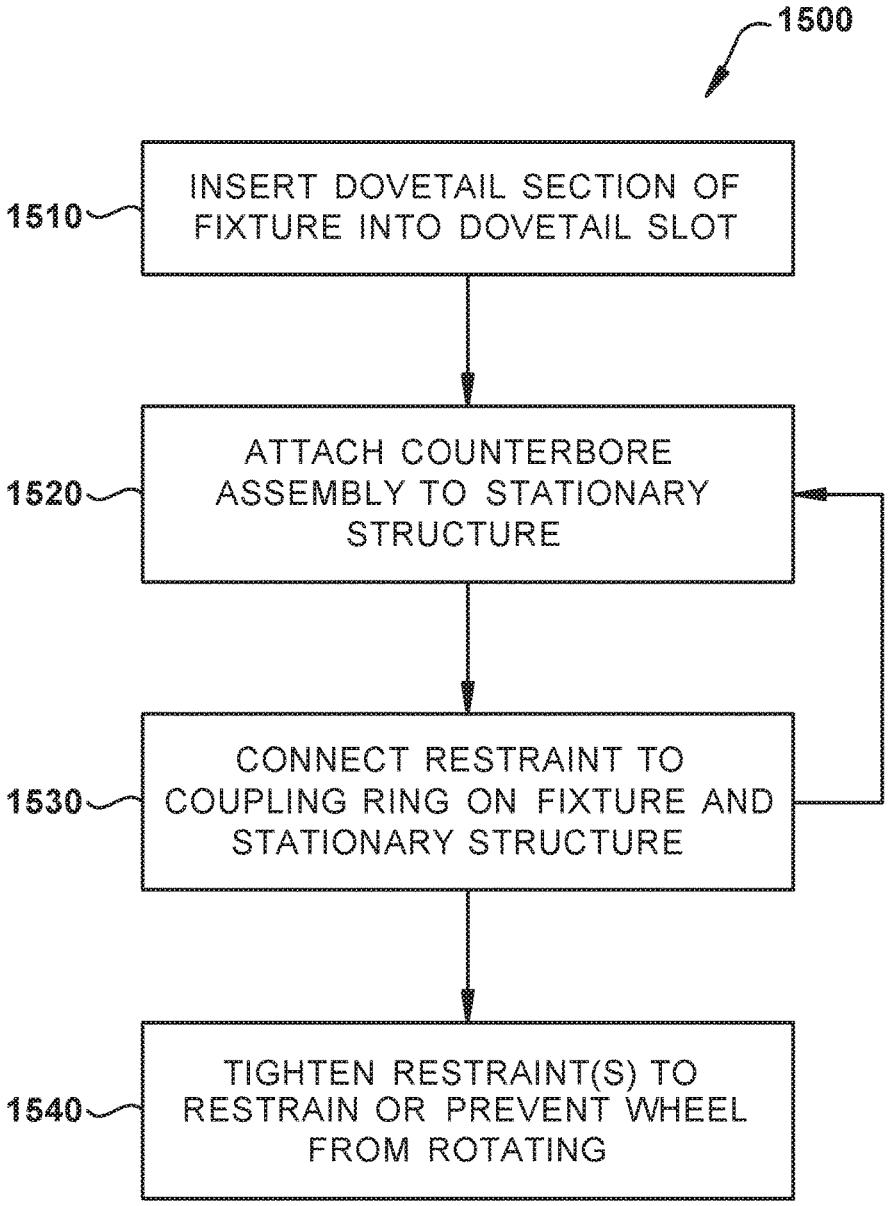
FIG. 15 is a flowchart for a method for restraining a wheel of a turbomachine.

FIG. 15 is a flowchart for a method 1500 for restraining a wheel 17 of a turbomachine. In step 1510 the fixture 210 is inserted into a dovetail slot 201 in the wheel 17. The fixture 210 includes a dovetail section 320 adapted for insertion into the dovetail slot 201, and a mounting section 330 located adjacent to, or formed integrally with, the dovetail section 320. The mounting section 330 is adapted to connect to at least one coupling ring 340. The coupling ring attaches to the top of the mounting section. Step 1510 may also include attaching a back plate and a sliding block to the mounting section 330. In addition, at least one coupling ring 340 may be attached to the mounting section 330 or the fixture 210 in general.

In step 1520, at least one counterbore assembly 810 is attached to a stationary structure 820. In step 1530 a restraint 830 is connected to the coupling ring 340 and the at least one counterbore assembly 810. Steps 1520 and 1530 may be repeated until the desired number of restraints are installed. Connecting step 1530 may also include attaching a come-along 1010 having a strap, chain 830 or cable to both the coupling ring 340 and the counterbore assembly 810 or other coupling ring 812 located on the stationary support. In step 1540, the restraints are tightened to restrain or prevent the wheel 17 from rotating.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A fixture for restraining rotation of a wheel of a turbomachine, the fixture comprising:

a dovetail section adapted for insertion into a dovetail slot of the wheel, the dovetail section having a dovetail shaped or fir tree shaped profile adapted to interlock with corresponding notches or recesses in the dovetail slot;

a first axial end and a second axial end, the first axial end located on an opposing side of the fixture from the second axial end, a back plate attached to the first axial end, the back plate adapted to extend over an axial face of the dovetail slot and restrain axial movement of the fixture, and wherein the back plate is comprised of a substantially rectangular and planar member;

a mounting section located adjacent to, or formed integrally with, the dovetail section;

at least one coupling ring attached to a top of the mounting section; and wherein the at least one coupling ring is adapted to be secured to a stationary anchoring point via a restraint thereby restraining rotation of the wheel, and the fixture further comprises a sliding block attached to the mounting section near the second axial end, the sliding block adapted to extend over an axial face of the dovetail slot and restrain axial movement of the fixture, and wherein the sliding block is adapted to slide up and down along a radial axis, with respect to the turbomachine, so that the fixture can be inserted into the dovetail slot when the sliding block is at an upper position, and the fixture is restrained from axial movement when the sliding block is in a lower position.

2. The fixture of claim 1, the sliding block further comprising a locking fastener adapted to screw into a threaded hole in the mounting section, the locking fastener adapted to restrain movement of the sliding block.

3. The fixture of claim 1, the dovetail section having one of:

a straight profile adapted for use with a straight dovetail slot, or an angled profile adapted for use with an angled dovetail slot, or a curved profile adapted for use with a curved dovetail slot.

4. The fixture of claim 1, the mounting section further comprising:

at least one threaded hole, in a top portion of the mounting section, adapted for attaching the coupling ring to the mounting section, and wherein a fastener secures the coupling ring to the mounting section via the at least one threaded hole.

5. The fixture of claim 1, further comprising:

a first coupling ring and a second coupling ring attached to a top portion of the mounting section.

6. A fixture for restraining rotation of a wheel of a turbomachine, the fixture comprising:

a dovetail section adapted for insertion into a dovetail slot of the wheel, the dovetail section having a dovetail shaped profile or fir tree shaped profile adapted to interlock with corresponding notches or recesses in the dovetail slot of the wheel, the dovetail section having an aft end and a forward end, both the aft end and the forward end having a threaded hole adapted for securing a fastener;

a mounting section located adjacent to, or formed integrally with, the dovetail section, the mounting section having at least one threaded hole adapted for attaching a coupling ring to the mounting section, and wherein a coupling fastener secures the coupling ring to the mounting section via the at least one threaded hole;

the coupling ring attached to a top portion of the mounting section;

the fixture having a first axial end and a second axial end, the first axial end located on an opposing side of the fixture from the second axial end, a back plate attached to the first axial end, the back plate adapted to extend over an axial face of the dovetail slot and restrain axial movement of the fixture, a sliding block is attached to the mounting section near the second axial end, the sliding block adapted to extend over an axial face of the dovetail slot and restrain axial movement of the fixture, and wherein the sliding block is adapted to slide up and down along a radial axis, with respect to the turbomachine, so that the fixture can be inserted into the dovetail slot when the sliding block is at an upper position, and the fixture is restrained from axial movement when the sliding block is in a lower position; and wherein the coupling ring is adapted to be secured to a stationary anchoring point via a restraint, thereby restraining rotation of the wheel.

7. The fixture of claim 6, the dovetail section having one of:

a straight profile adapted for use with a straight dovetail slot, or an angled profile adapted for use with an angled dovetail slot, or a curved profile adapted for use with a curved dovetail slot.

8. A method for restraining rotation of a wheel of a turbomachine, the method comprising:

inserting a fixture into a dovetail slot in the wheel, the fixture comprising:

a dovetail section adapted for insertion into the dovetail slot;

a mounting section located adjacent to, or formed integrally with, the dovetail section, the mounting section adapted to connect to a coupling ring, the coupling ring attached to a top portion of the mounting section;

attaching at least one counterbore assembly to a stationary structure;

connecting a restraint to the at least one coupling ring and the at least one counterbore assembly, thereby restraining rotation of the wheel; and wherein the fixture comprises a first axial end and a second axial end, the first axial end located on an opposing side of the fixture from the second axial end, a back plate attached to the first axial end, the back plate adapted to extend over an axial face of the dovetail slot and restrain axial movement of the fixture, and a sliding block is attached to the mounting section near the second axial end, the sliding block adapted to extend over an axial face of the dovetail slot and restrain axial movement of the fixture, and wherein the sliding block is adapted to slide up and down along a radial axis, with respect to the turbomachine, so that the fixture can be inserted into the dovetail slot when the sliding block is at an upper position, and the fixture is restrained from axial movement when the sliding block is in a lower position.

9. The method of claim 8, the stationary structure comprising at least one of:

a shell, a flange or a casing of the turbomachine.

10. The method of claim 9, the inserting a fixture step further comprising:

attaching the back plate to the first axial end of the fixture.

11. The method of claim 10, the inserting a fixture step further comprising:

attaching the sliding block to the second axial end of the fixture.

12. The method of claim 11, the connecting step further comprising:

attaching a come-along having a strap, chain or cable to both the coupling ring and the at least one counterbore assembly, and tightening the come-along to restrain the wheel.

* * * * *